US011151851B1

(12) United States Patent
Moix Olive et al.

(10) Patent No.: US 11,151,851 B1
(45) Date of Patent: Oct. 19, 2021

(54) TRACE HEATING BASE FOR HEATING DETECTORS

(71) Applicant: Carrier Corporation, Palm Beach Gardens, FL (US)

(72) Inventors: Pere Moix Olive, Barcelona (ES); Pablo Solis Vidal, Barcelona (ES)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/130,266

(22) Filed: Dec. 22, 2020

(30) Foreign Application Priority Data

May 22, 2020 (EP) ..... 20176142

(51) Int. Cl.
*G08B 17/06* (2006.01)
*H05B 1/02* (2006.01)
*G08B 21/18* (2006.01)

(52) U.S. Cl.
CPC ..... *G08B 17/06* (2013.01); *G08B 21/182* (2013.01); *H05B 1/0227* (2013.01)

(58) Field of Classification Search
CPC ..... G08B 17/06; G08B 21/182; H05B 1/027
See application file for complete search history.

(56) References Cited

U.S. PATENT DOCUMENTS 4,486,743 A * 12/1984 Brown ..... G08B 21/182 110/193
2003/0218530 A1* 11/2003 Yoshinari ..... H01C 17/06586 338/22 R
2005/0116808 A1* 6/2005 Tosaka ..... H01C 7/027 338/22 R
2010/0280788 A1* 11/2010 Bohan ..... G01K 3/10 702/130
2011/0084060 A1* 4/2011 Kang ..... B29C 43/206 219/494

FOREIGN PATENT DOCUMENTS

| | | | |
|---|---|---|---|
| CN | 202167124 | U | 3/2012 |
| CN | 202404044 | U | 8/2012 |
| CN | 204926450 | U | 12/2015 |
| EP | 1017034 | A2 | 7/2000 |
| GB | 1428588 | A | 3/1976 |
| JP | H0822590 | A | 1/1996 |
| JP | H08315271 | A | 11/1996 |
| JP | 2011113378 | A | 6/2011 |
| KR | 20150125462 | A | 11/2015 |
| KR | 1761110 | B1 | 7/2017 |
| KR | 20180125072 | A | 11/2018 |

OTHER PUBLICATIONS

European Search Report for application EP 20176142.6, dated Oct. 15, 2020, 8 pages.

* cited by examiner

*Primary Examiner* — Ojiako K Nwugo
(74) *Attorney, Agent, or Firm* — Cantor Colburn LLP

(57) ABSTRACT

A heat detection system for a fire alarm, the heat detection system including: a heat detection device including at least one heat sensor and an alarm system for triggering an alert when the heat sensor indicates a temperature exceeding a threshold; and a self-regulating heater operable to maintain the heat detection device at a predefined application temperature during use.

10 Claims, 3 Drawing Sheets

TRACE HEATING BASE FOR HEATING DETECTORS

FOREIGN PRIORITY

This application claims priority to European Patent Application No. 20176142.6 filed May 22, 2020, the entire contents of which is incorporated herein by reference.

TECHNICAL FIELD

The invention relates to a heat detection system for a fire alarm and a related method for operating the heat detection system.

BACKGROUND

Heat detectors are used to detect and provide an alert of a fire in environments where smoke detectors are unsuitable. Smoke detectors provide an earlier warning of fire than heat detectors since there is a greater lag in time between creation of heat source and an increase in ambient temperature compared to the creation and detection of smoke. However in certain environments that contain high levels of fumes or contaminants such as dust, or in environments that do not have adequate air conditioning or ventilation, smoke detectors can trigger many false alarms meaning heat detectors can be more suitable.

Heat detectors must conform to the standards designated by the European Union's EN 54-5 classification and regulations. The European Standard EN 54-5 classifies heat detectors using the typical application temperature (the temperature at which a detector, once installed, is expected to experience for prolonged periods of time in the absence of a fire condition) and the maximum application temperature (the highest temperature at which they can safely be used without risk of false alarm). The classes are identified by the letters A to G as shown in Table 1. In addition to the basic classification, detectors can also be identified by a suffix to identify that they are rate-of-rise (suffix R) or fixed (static) temperature (suffix S) type heat detectors. S type heat detectors will raise an alarm when it detects a temperature equal to or greater than a pre-defined temperature (the static temperature). The EN54-5 classification provides a range of static temperatures at which a detector must raise an alarm for a given standard classification i.e. A-G, see Table 1. R type detectors will raise an alarm when the rate of temperature rise is equal to or greater than a pre-defined rate, a further classification provides the allowable ranges for the detection rates at which a given detector may raise an alarm to be allowable. As such heat detectors are selected on the basis of the conditions of their expected environment, the temperature they will typically operate at (e.g. Table 1).

4.2 Classification

Detectors shall conform to one or more of the following classes: A1, A2, B, C, D, E, F or G according to the requirements of the tests specified in clause 5 (see Table 1).

TABLE 1

Detector classification temperatures

| Detector Class | Typical Application Temperature ° C. | Maximum Application Temperature ° C. | Minimum Static Response Temperature ° C. | Maximum Static Response Temperature ° C. |
|---|---|---|---|---|
| A1 | 25 | 50 | 54 | 65 |
| A2 | 25 | 50 | 54 | 70 |
| B | 40 | 65 | 69 | 85 |

TABLE 1-continued

Detector classification temperatures

| Detector Class | Typical Application Temperature ° C. | Maximum Application Temperature ° C. | Minimum Static Response Temperature ° C. | Maximum Static Response Temperature ° C. |
|---|---|---|---|---|
| C | 55 | 80 | 84 | 100 |
| D | 70 | 95 | 99 | 115 |
| E | 85 | 110 | 114 | 130 |
| F | 100 | 125 | 129 | 145 |
| G | 115 | 140 | 144 | 160 |

Testing must be carried out in order to prove that a detector meets the standards appropriate for its classification. S type detectors must meet the requirements of EN54-5 so that the detection of its pre-defined static temperature must occur within a specific response time once the ambient temperature reaches the static temperature. This time for detection cannot be too short in order to avoid false alarms due to errors or 'spikes' in temperature detection but cannot be too long so that alarms are raised without undue delay. During the test the detector is placed inside a heat tunnel and is first conditioned at the relevant typical application temperature. The temperature of the heat tunnel and device is then raised to the maximum application temperature and the time taken to produce an alarm is recorded. These EN54 tests require that the detector performance is tested at the detectors typical application temperature only. Crucially, the test does not test the detector's performance at a temperature below the typical application temperature. This may result in a detector that is certified for use but that is not effective, or not sufficiently operational, at a temperature lower than that of the designated typical application temperature. It is not uncommon however that the temperature of a detector's environment may fall below the expected typical application temperature in which case it is not possible to know from the standard tests whether the detector is able to operate effectively to report an alarm. The present invention can be utilised in devices conforming to other standards and regulations also. These include the BS5446-2 standard for heat alarms within the bracket of fire detection and alarm devices for dwellings, and the EN54-29 standard for point type multi-sensor fire detectors containing a smoke detector and a heat detector.

It would be beneficial to improve heat detection systems so that given the current testing standards the effectiveness of the detector is known to not be reduced whilst experiencing an ambient temperature lower than that of its typical application temperature at which the tests are conducted. The present invention addresses this by ensuring that the temperature experienced by the detector does not fall below the tested temperature, the typical application temperature, where it is known that the detectors performance meets the correct safety standards. The invention disclosed achieves this by employing a self-regulating heater to maintain the typical application temperature of each detector. The invention may optionally include that the self-regulating heater comprises a conductive positive temperature coefficient (PTC) material.

SUMMARY

Viewed from a first aspect, the invention provides a heat detection system for a fire alarm, the heat detection system comprising; a heat detection device comprising at least one heat sensor and an alarm system for triggering an alert when the heat sensor indicates a temperature exceeding a threshold; and a self-regulating heater operable to maintain the heat detection device at a predefined application temperature during use.

The above arrangement can allow for improvements in the performance of the heat detector when the ambient temperature surrounding the detector in its installed state drops below the temperature at which the detector is known to operate effectively to meet the safety standards. The heat detector and associated software, where present, may advantageously be set up so that the heat detector will pass the tests and comply to the safety standards of the European Union's EN 54-5 classification and regulations. Thus, the threshold temperature may be a static temperature at a level as defined in EN 54-5. More generally, the alarm system may trigger an alarm in response to detection of a temperature that exceeds a static temperature, wherein the static temperature is a threshold value within the range 54° C. to 160° C., such as being any one of the temperatures specified by EN54-5 as set out above. As discussed above, these standards require that the performance of the detector at its typical application temperature is verified. The algorithm may therefore not be suitable to produce an alarm with sufficient reliability or may produce an abnormal response when the temperature falls below the typical application temperature. By using a self-regulating heater to ensure the temperature of the detector sensors remain at the typical application temperature, the detrimental effects of reduced ambient temperature on the performance of the heat detector can be avoided. The heater is self-regulating in the sense that the material of the heating portion of the heater regulates the temperature of the self-regulating heater. The self-regulating heater therefore does not require additional components involved in regulating of the temperature of the heater. Therefore components such as regulating electronics, temperature sensors, overheat protection apparatus are not required. The temperature that a self-regulating heater will maintain is hence determined by the properties of the heater material, such as the composition and the microstructure, and the voltage supplied to it. The predefined application temperature may for example be any one of the application temperatures specified by EN54-5, as set out above, for example with the self-regulating heater being operable to keep the heat detection device above one of the minimum application temperatures mentioned above. More generally speaking the self-regulating heater may be operable to keep the heat detection device above a temperature in the range 25° C. to 115° C. That is to say the self-regulating heater may be configured to maintain the ambient temperature of the heat detection device at a temperature in the range of 25° C. to 115° C. The self-regulating heater hence maintains the temperature of the heat detection device at the relevant application temperature for the respective classification of the heat detection device.

The heater optionally comprises a self-regulating conductive positive temperature coefficient (PTC) material. It may be possible to provide a similar solution by employing the use of a simple resistor to maintain the temperature of the detector at its desired typical application temperature, however problems would arise in these systems as a result of the variations in temperature that such a resistor may produce, and a resistor implementation would also include the need to monitor and control heating from the resistor using external components. By using self-regulating conductive PTC materials to provide temperature stabilisation at the detector instead, the disclosed heat detector can overcome the challenges associated with the resistor based devices due to the self-regulating nature of the PTC. The PTC material produces heat as a result of current flowing through the material when connected in an electrical circuit, and the resistance of the material to that current causing energy to be dissipated as heat. The PTC material increases in temperature as heat is produced. The resistance of the PTC material increases as the temperature of the material increases; this means that less current can pass through the material as the temperature of the material increases for a given applied voltage. This also means that less heat is dissipated by the material as less energy is supplied to it resulting from the reduction in current. As a result, for a given applied voltage, the material reaches an equilibrium position where the heat expelled by the material equals the heat generated through resistive heating. The temperature of the material therefore remains constant during this equilibrium condition. The PTC material can therefore keep a constant temperature regardless of how the ambient temperature changes because of this equilibrium process. The temperature of the material's equilibrium condition can be selected through tailoring the composition and/or microstructure of the material or by altering the voltage applied to the material.

A further advantage of the PTC self-regulating heater is that no additional components are required for the regulation of the device and its temperature. The PTC material effectively acts as its own temperature sensor and external feedback control. Because of the intrinsic equilibrium temperature condition exhibited by the PTC material, the self-regulating PTC heater inherently minimises the risk of the device over-heating, as well as reducing the number of components that may fail leading to an over-heating event. Advantageously, minimising the over-heating events caused by the temperature regulation system correspondingly minimises the occurrence of false alarms produced by such an over-heating event, therefore reducing the number of false alarms produced by the detection device and hence improving its efficiency.

It may be possible to use a resistor to provide heat to the heat detection system raising the ambient temperature to that of the appropriate application temperature, however the heating effect from the resistors is less precise and requires greater complexity to control and regulate the temperature. A resistor based system would thus require added control/temperature regulation components to achieve the required self-regulating function. It is hence considered advantageous to use a PTC heater instead. The heat produced by the heating element of the resistor must be controlled externally, by varying the current or voltage of the resistor in response to the difference between a measured temperature and the desired temperature. This process leads to less stable and less accurate temperature maintenance compared to using a self-regulating conductive PTC heater.

The use of resistors is further complicated by the variability in the ambient temperature; the resistor having a set heat output may cause an over or under heating effect caused by fluctuation of the ambient temperature. For example, if the required application temperature is 20 degrees above the expected ambient temperature the heat output of the resister is tailored to achieve the required rise in temperature, if the ambient temperature were to increase, or decrease, the same heat output from the resister would result in a temperature higher than the application temperature or lower than the application temperature respectively. Advantageously, the heat detection system disclosed can set the temperature of the overall heat detector with independence of the ambient temperature by means of a self-regulating conductive PTC heater at the detector base.

A further advantage of the PTC heater is the increased efficiency and reduced power requirements. PTC heaters only draw full power during the initial heat up when going from ambient temperature to their equilibrium temperature. As the temperature difference between ambient and equilibrium temperature decreases the power consumption drops meaning that maintaining the equilibrium, or in the case of the heat detectors their typical application temperature, requires low power. As the function of the PTC heater in this heat detection device is to maintain the typical application temperature this power consumption profile means that the heater has increased energy efficiency compared to a resistor which does not inherently vary its power consumption between its heat-up and temperature maintenance phases.

The heat detection system including the self-regulating PTC heaters therefore achieves high reliability and high efficiency, with a faster, safer, more uniform heating effect than a heat detection system employing temperature maintenance system involving a resistor.

The heat detection system of the first aspect minimizes the effect of ambient temperature variations on the heat detection system. In particular the heat detection system minimises the effect of the ambient temperature being lower than the typical application temperature for which the detector is designed and on which the algorithm of the alarm system is based. Therefore, heat detectors meeting the EN54 regulations may be installed in cold environments where it would otherwise not be possible to maintain their reliability or ensure the accuracy of the detectors owing to the reduced temperatures.

With the use of a self-regulating heating implemented via a PTC material, the PTC material may be provided so as to surround the at least one heat sensor of the heat detector device and where a plurality of heat sensors are provided the PTC material may surround all of the heat sensors of the heat detector device. This allows for a controlled and even distribution of the heat generated by the PCT material around the heat detection device so that the entirety of the heat sensors are maintained at the correct application temperature.

The PTC material of the heat detection system may be in the form of a cable. This enables an efficient construction of the heat detection system since the cable can be arranged to reside next to the heat sensors and may be provided so as to fit within small dimensions of the free space with the device. In this way all of the heat sensors can be maintained at the application temperature using only one PTC heater. This again allows for a simplified and efficient construction of the device.

The PTC heater may be connected to a buck-boost regulator for varying the voltage that is supplied to the self-regulating heater. The PTC heater may be controlled using the buck-boost regulator such that the buck setting decreases the voltage supplied to the PTC material and the boost setting increases the voltage to the PTC heater. The ability to alter the voltage applied to the PTC heater from the voltage which is supplied increases the flexibility of installation and increases the simplicity of the heat detector system since the same power source can be used to power the heat detection components such as the sensors and processor as that which supplies power to the heater, even though the voltage requirements may be different. This is particularly important for the PTC heater since the voltage supplied to it determines the equilibrium temperature at which the PTC element is able to self-regulate. Using the buck-boost regulator to define the temperature of the heater means that a single device is capable of operating at different application temperatures.

The heat detection system may comprise an internal power system having an in-built power supply. Either or both of the heat detection device and the self-regulating heater may be powered by the internal power system of the heat detection system. The heat detection system may, alternatively to or in addition to the internal power system and in-built power supply, be connected to an external power supply which may power either or both of the heat detection device and the self-regulating heater. In this way the heat detection system is adaptable to the provisions available within the environment of the installation location.

By connecting the self-regulating heater to the internal power system of the heat detection system, the heat detection system may be transportable and it may be placed in areas that may otherwise be restricted. By connecting the self-regulating heater to an external power supply the functioning of the self-regulating heater may be more reliable; this may be useful in particularly high risk environments. In addition more power may be provided using a custom provided external power supply to more closely match the requirements of the self-regulating heater, which may be useful in particularly harsh environments such as cold places where high heat output from the self-regulation heater is required to maintain the heat detection device at the correct application temperature.

The heat detection device may be an S type heat detection device such that an alarm is raised if the temperature detected reaches or exceeds the pre-defined static temperature. S type heat detection devices are useful in environments where the temperature is expected to rise and fall at a high rate independent of a fire condition, for example a boiler room. In these conditions an R type heat detector may produce false alarms.

Viewed from a second aspect, the invention extends to a method for operating a heat detection system as in the first aspect, the method comprising using the self-regulating heater to maintain the temperature of the at least one heat sensor at a predefined application temperature, using the heat sensor to detect a measured temperature within the heat detection device, and raising an alarm when the measured temperature reaches or exceeds a predefined static temperature.

The method may include the use of a heat detection system having other features as discussed above in connection with optional features of the first aspect. The step of raising the alarm may be done via the alarm system.

Viewed from a third aspect, the invention extends to a method of manufacture of a heat detection system including providing a self-regulating heater and a heat detection device. The self-regulating heater may be fitted to the heat detection device during manufacture of the heat detection system. In other embodiments the self-regulating heater may be supplied following the manufacture of a heat detection device and retrofitted to the heat detection device so as to complete the heat detection system. The self-regulating heater may be adaptable so as to fit onto heat detection devices produced, installed or manufactured prior to production of the self-regulating heater. In this way the self-regulating heater may be provided separately to the heat detection device and the self-regulating heater may be provided as an accessory to the heat detection device. By supplying the self-regulating heater independently to the heat detection device, devices currently in use need not be replaced by a new heat detection device, but can instead be modified to gain the advantages of the self-regulating heater. For example, heat detectors that conform to the EN54-5 standards but report false alarms mainly caused by abrupt temperature changes, as discussed above, can be modified by the self-regulating heater of the present invention in order to minimize the drawbacks with the non-modified detectors as discussed above.

A heat detection device implementing this invention may be utilized in commercial installations such as kitchens, restaurants, bakeries etc. where heat detectors are installed next to ovens, fridges, stoves or the like and which may result in multiple false alarms. By using the self-regulating heater to set the application temperature, false alarms caused by abrupt temperature changes can be minimized Examples of such situations include opening of a fridge door (causing an abrupt decrease in temperature) or opening of an oven door (causing an abrupt increase in temperature).

DRAWING DESCRIPTION

Certain embodiments of the invention will now be described by way of example only and with reference to the accompanying drawings in which.

DETAILED DESCRIPTION

Figure 1:
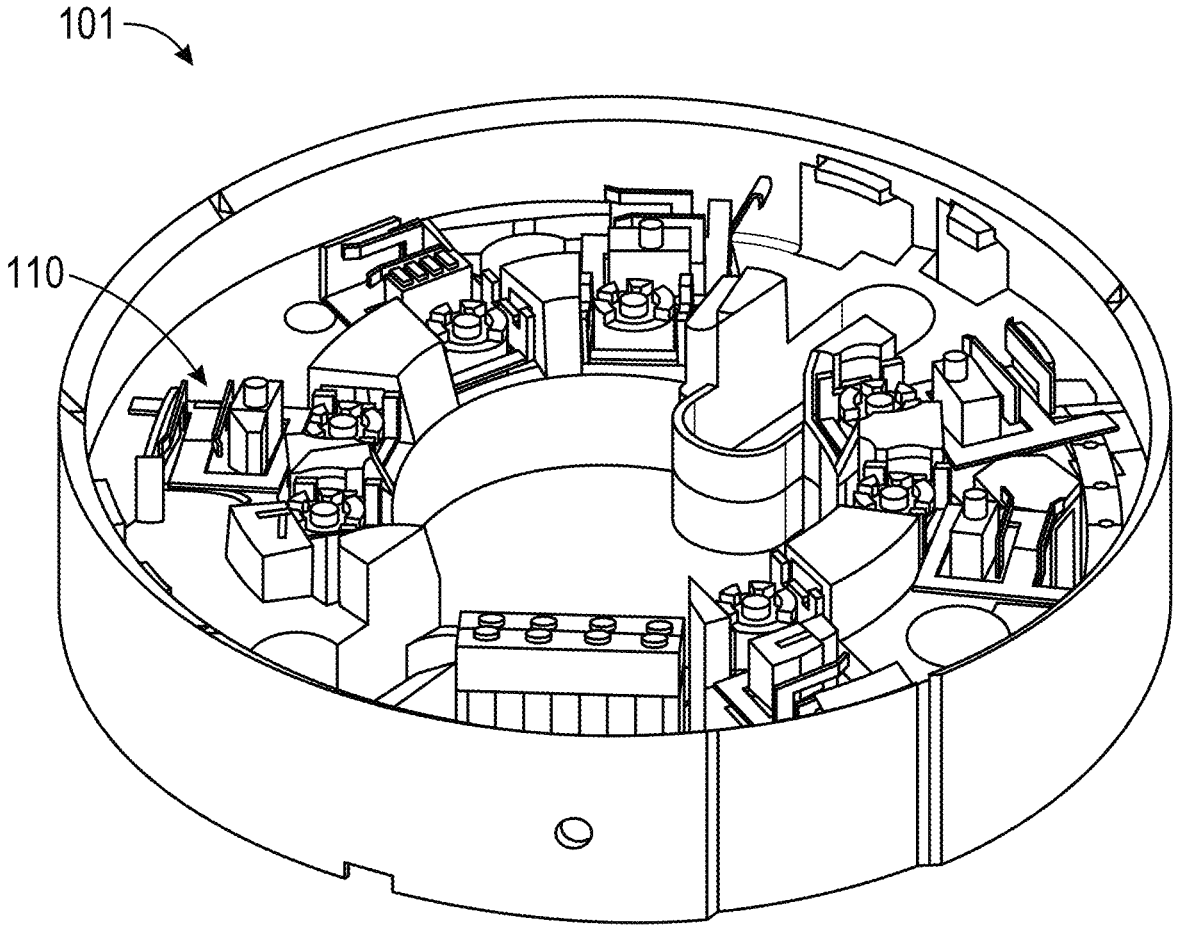
FIG. 1 is a drawing of heat detection base or substrate.

As seen in FIG. 1, a heat detection base 101 includes brackets 110. The brackets 110 are used to hold the cables and/or circuitry within the heat detection device 100 in place.

Figure 2:
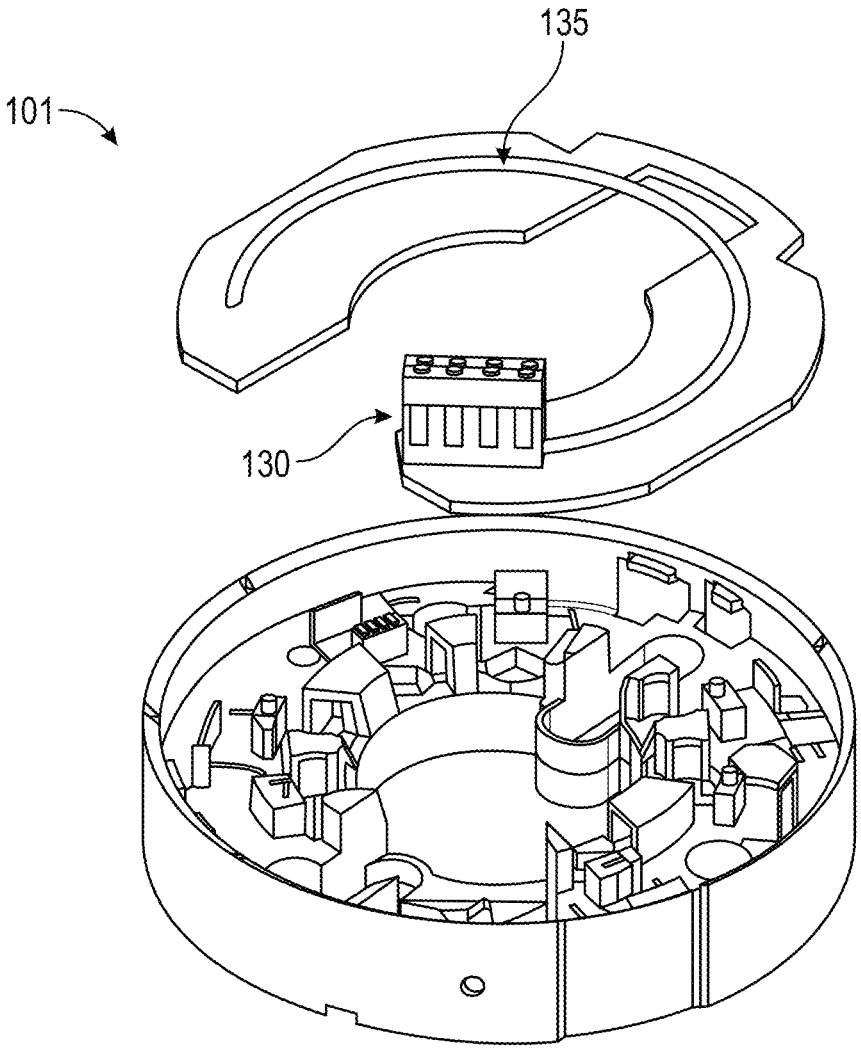
FIG. 2 is an expanded diagram of a heat detection base or substrate and a PTC self-regulating heater.

As seen in FIG. 2, a self-regulating heater 130 comprising a self-regulating conductive positive temperature coefficient (PTC) material 135 is provided within the heat detection base or substrate 101. The self-regulating heater 130 is disposed above the substrate 101 in the view shown in FIG. 2. As such the self-regulating heater within the heat detection base or substrate may be provided independently of a heat detection device and retrofitted to any such heat detection device, as demonstrated in FIG. 3.

Figure 3:
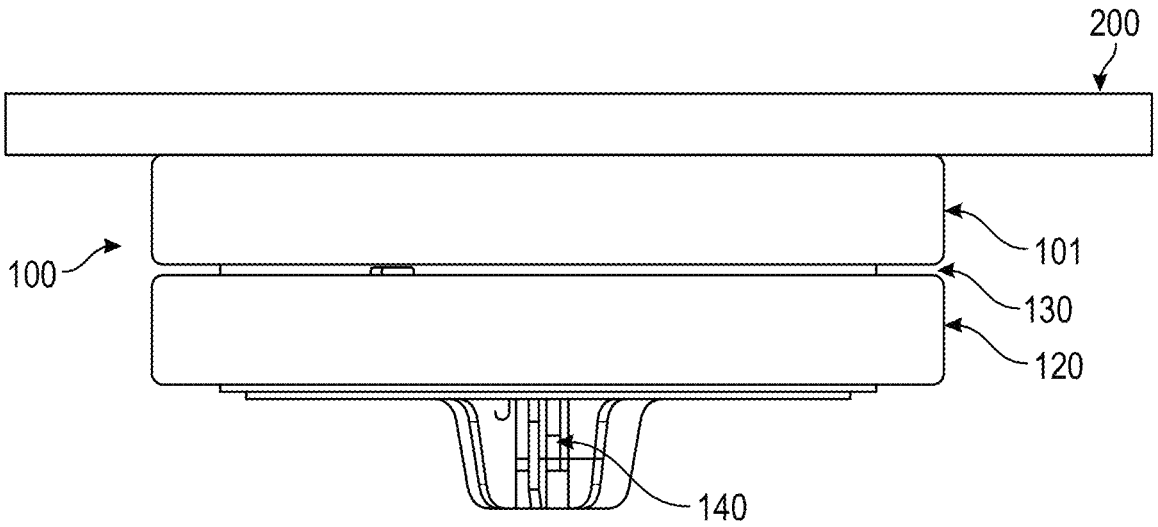
FIG. 3 is an example of the heat detection device in an installed position.

In FIG. 3 it can be seen that the self-regulating heater 130 may be disposed between a heat detection device 120 and the heat detection base or substrate 101. The self-regulating heater 130 may be placed within the base or substrate 101 so that in an installed position, as an alternative to the arrangement shown in FIG. 3, the self-regulating heater 130 resides underneath the heat detection sensor(s) within the heat detector 120 and thereby provides the most effective supply of heat to the sensor(s). However, the invention is not limited to this positioning of the self-regulating heater 130 and thus the self-regulating heater 130 may be placed in other locations in the vicinity of the heat detection sensor(s) whilst operating within the scope of the appended claims.

The PTC material 135 is provided in the form of a cable and is able to surround the components of the heat detection device ensuring it is able to supply a complete and even coverage of heat throughout the heat detection device 100 so that the temperature is regulated throughout the heat detector 120 and so that the heat sensor(s) are maintained at the appropriate temperature. For example, the temperature can be controlled by self-regulating heater 120 to achieve a required application temperature as discussed above, which may be in line with the requirements set by EN 54-5.

The self-regulating heater 130 may be connected to the power source of the heat detection device 100, or may be connected to an external power source.

The self-regulating heater 130 may comprise a buck-boost regulator with over current protection. The function of the buck boost regulator is to alter the input voltage into the heater to the specific voltage required by the PTC material according to the typical application temperature for the device. The voltage provided to the PTC material may be greater than or less than the voltage supplied to the buck-boost regulator. The equilibrium temperature of the PTC material is dependent on the composition and/or microstructure of the material and the voltage applied to the material. It is therefore important that the correct voltage is supplied to the material to ensure the application temperature required by the classification of the device is met. The use of the buck-boost regulator ensures that the device is adaptable to the meet the requirements of the heater independently of the power source to which it is connected.

The heat detection device 120 can be an S type heat detector of any suitable type, with the self-regulating heater 130 being configured to ensure an application temperature appropriate for the selected heat detection device 100 and its environment.

As discussed above, in FIG. 3 the heat detection device 100 is shown in an installed position having been secured to a ceiling 200. The heat detection base or substrate 101 comprising the self-regulating heater 130 and PTC material 135 is secured to the ceiling 200, and the heat detector 120 with heat sensors(s) 140 is fixed to the heat detection base or substrate 101.

What is claimed is:

1. A heat detection system for a fire alarm, the heat detection system comprising:

a heat detection device comprising at least one heat sensor and an alarm system for triggering an alert when the heat sensor indicates a temperature exceeding a threshold; and a self-regulating heater operable to maintain the heat detection device at a predefined application temperature during use;

wherein the self-regulating heater comprises a conductive positive temperature coefficient (PTC) material;

wherein the PTC material surrounds the at least one heat sensor of the heat detection device.

2. A method of heat detection using the heat detection system of claim 1, comprising:

using the self-regulating heater to maintain the temperature of the at least one heat sensor at a predefined application temperature, using the heat sensor to detect a temperature within the heat detection device, raising an alarm when the temperature reaches or exceeds a predefined static temperature.

3. A heat detection system for a fire alarm, the heat detection system comprising:

a heat detection device comprising at least one heat sensor and an alarm system for triggering an alert when the heat sensor indicates a temperature exceeding a threshold; and a self-regulating heater operable to maintain the heat detection device at a predefined application temperature during use;

wherein the self-regulating heater comprises a conductive positive temperature coefficient (PTC) material;

wherein the PTC material comprises a cable.

4. A heat detection system for a fire alarm, the heat detection system comprising:

a heat detection device comprising at least one heat sensor and an alarm system for triggering an alert when the heat sensor indicates a temperature exceeding a threshold; and a self-regulating heater operable to maintain the heat detection device at a predefined application temperature during use;

wherein the self-regulating heater is operable to keep the heat detection device above a temperature in the range 25° C. to 115° C.

5. A heat detection system for a fire alarm, the heat detection system comprising:

a heat detection device comprising at least one heat sensor and an alarm system for triggering an alert when the heat sensor indicates a temperature exceeding a threshold; and a self-regulating heater operable to maintain the heat detection device at a predefined application temperature during use;

wherein the self-regulating heater is connected to a buck-boost regulator for varying the voltage that is supplied to the self-regulating heater.

6. A heat detection system as claimed in claim 5, wherein the buck-boost regulator is controlled by the heat detection device so that the heat detection device may select a temperature for the self-regulating heater which may be achieved by changing the voltage supplied to the self-regulating heater.

7. A heat detection system as claimed in claim 5, wherein the heat detection device is connected to an external power supply, wherein the buck-boost regulator is powered by the external power supply.

8. A heat detection system as claimed in claim 5, further comprising an internal power system having an in-built power supply, wherein the buck-boost regulator is powered by the in-built power supply of the heat detection system.

9. A heat detection system for a fire alarm, the heat detection system comprising:

a heat detection device comprising at least one heat sensor and an alarm system for triggering an alert when the heat sensor indicates a temperature exceeding a threshold; and a self-regulating heater operable to maintain the heat detection device at a predefined application temperature during use;

wherein the heat detection device is an S type heat detection device.

10. A method of manufacture of a heat detection system comprising:

providing a self-regulating heater and a heat detection device;

wherein the self-regulating heater is provided as an accessory to the heat detection device, the self-regulating heater being retrofitted to the heat detection device.

* * * * *